US012110906B2

(12) United States Patent
Hu et al.

(10) Patent No.: US 12,110,906 B2
(45) Date of Patent: Oct. 8, 2024

(54) HEAT COLLECTING PUMP AND DOMESTIC APPLIANCE

(71) Applicants: Guangdong Midea White Home Appliance Technology Innovation Center Co., Ltd., Foshan (CN); Midea Group Co., Ltd., Foshan (CN)

(72) Inventors: Xiaowen Hu, Foshan (CN); Site Hu, Foshan (CN); Longzhen Dai, Foshan (CN); Richao Liu, Foshan (CN); Fagang Tan, Foshan (CN); Hui Zhang, Foshan (CN)

(73) Assignees: GUANGDONG MIDEA WHITE HOME APPLIANCE TECHNOLOGY INNOVATION CENTER CO., INC., Foshan (CN); MIDEA GROUP CO., LTD., Foshan (CN)

( * ) Notice: Subject to any disclaimer, the term of this patent is extended or adjusted under 35 U.S.C. 154(b) by 442 days.

(21) Appl. No.: 17/524,699

(22) Filed: Nov. 11, 2021

(65) Prior Publication Data

US 2022/0074428 A1 Mar. 10, 2022

Related U.S. Application Data

(63) Continuation of application No. PCT/CN2019/123362, filed on Dec. 5, 2019.

(30) Foreign Application Priority Data

May 29, 2019 (CN) ..... 201910458512.5

(51) Int. Cl.
*F04D 29/44* (2006.01)
*A47L 15/42* (2006.01)
(Continued)

(52) U.S. Cl.
CPC ..... *F04D 29/448* (2013.01); *F04D 29/007* (2013.01); *A47L 15/4225* (2013.01); *F04D 29/588* (2013.01)

(58) Field of Classification Search
CPC ... F04D 29/448; F04D 29/007; A47L 15/4225
See application file for complete search history.

(56) References Cited

U.S. PATENT DOCUMENTS 6,254,359 B1 7/2001 Aber
2013/0216370 A1 8/2013 Roth et al.

FOREIGN PATENT DOCUMENTS

CN 102588304 A 7/2012
CN 103553163 A 2/2014
(Continued)

OTHER PUBLICATIONS

Midea Group Co., Ltd., Korean Office Action, KR Patent Application No. 10-2021-7037115, Jul. 5, 2023, 9 pgs.
(Continued)

*Primary Examiner* — Nathan C Zollinger
(74) *Attorney, Agent, or Firm* — Morgan, Lewis & Bockius LLP

(57) ABSTRACT

A heat collecting pump includes: a flow guide member, including a flow guide body and a flow guide blade, wherein the flow guide blade is disposed on an outer peripheral wall of the flow guide body; a heating member, disposed on a periphery of the flow guide member and spaced apart from the flow guide blade. The flow guide blade enables water to flow along the outer peripheral wall of the flow guide body to form a first whirlwind flow and to further form a second whirlwind flow in a gap between the heating member and the flow guide blade. Projections of velocity directions of the first whirlwind flow and the second whirlwind flow on a reference plane perpendicular to the axial direction of the flow guide body are in opposite directions; and the second
(Continued)

whirlwind flow removes bubbles gathered on the heating member.

18 Claims, 6 Drawing Sheets

(51) Int. Cl.
*F04D 29/00* (2006.01)
*F04D 29/58* (2006.01)

(56) References Cited

FOREIGN PATENT DOCUMENTS

| | | | | | |
|---|---|---|---|---|---|
| CN | 204805151 | U | | 11/2015 | |
| CN | 107869481 | A | | 4/2018 | |
| CN | 107947492 | A | | 4/2018 | |
| CN | 207363899 | U | | 5/2018 | |
| CN | 108843587 | A | * | 11/2018 | ..... A47L 15/4225 |
| CN | 208725679 | U | | 4/2019 | |
| CN | 110798122 | A | | 2/2020 | |
| DE | 3709272 | A | * | 9/1988 | ..... D06F 39/04 |
| DE | 3709272 | A1 | | 9/1988 | |
| DE | 10312978 | A1 | | 10/2004 | |
| EP | 1159911 | A2 | * | 12/2001 | ..... A47L 15/4285 |
| JP | 2014013002 | A | | 1/2014 | |
| KR | 101862709 | B1 | | 5/2018 | |

OTHER PUBLICATIONS

Chinese First Office Action Chinese Application No. 201910458512.5, mailed Feb. 8, 2021 15 pgs.
Notification to Grant Patent Right for Invention Chinese Application No. 201910458512.5, mailed Jul. 5, 2021 6 pgs.
International Search Report International Application No. PCT/CN2019/123362, mailed Mar. 2, 2020, 13 pgs.
Extended European Search Report, EP19931399.0, May 31, 2022, 9 pgs.
Midea Group Co., Ltd., IPRP, PCT/CN2019/123362, Nov. 16, 2021, 4 pgs.
Midea Group Co., Ltd., Japanese Office Action, JP Patent Application No. 2021-568955, Nov. 29, 2022, 9 pgs.
Midea Group Co., Ltd., European Office Action, EP Patent Application No. 19931399.0, Jan. 3, 2024, 8 pgs.
Midea Group Co., Ltd., Korean Office Action, KR Patent Application No. 10-2021-7037115, Jan. 17, 2024, 10 pgs.

* cited by examiner

HEAT COLLECTING PUMP AND DOMESTIC APPLIANCE

CROSS REFERENCE TO RELATED APPLICATIONS

The present application is a continuation application of International (PCT) Patent Application No. PCT/CN2019/123362, filed on Dec. 5, 2019, which claims foreign priority of China Patent Application No. 201910458512.5, filed on May 29, 2019, in the title of "Heat Collecting Pump and Domestic Appliance," in the China National Intellectual Property Administration, the entire contents of which are hereby incorporated by reference.

TECHNICAL FIELD

The present disclosure relates to the field of domestic appliances, and in particular to a heat collecting pump and a domestic appliance.

BACKGROUND

Dishwasher may be provided in many houses. The dishwasher is substantially configured to automatically wash dishes. The dishwasher may have functions, such as washing, sanitizing, drying, and so on. In order to effectively melt oil and remove microorganisms, water for washing the dishes may be heated to a certain temperature. Therefore, a heating member may be configured in a water pump or in a bottom space of other components of the dishwasher.

The increasingly compact structure of modern dishwashers often requires the water pump and the heating member to be made into one integral and overall structure, forming a heat collecting pump. In the art, water flow that enters the heat collecting pump may carry many bubbles, or many bubbles may be produced while the water is entering the heat collecting pump. Further, the structure of the heat collecting pump in the art may enable the bubbles to gather in a blind zone of the heating member that does not contact the water flow. As thermal conductivity of the air in the bubbles is much less than that of the water, dry burning may occur on the heating member, which may burn and damage the heating member.

SUMMARY OF THE DISCLOSURE

The present disclosure provides a heat collecting member and a domestic appliance to solve the problem of dry burning on the heating member.

According to an aspect of the present disclosure, a heat collecting pump includes: a flow guide member, comprising a flow guide body and at least one flow guide blade, wherein the at least one flow guide blade is disposed on an outer peripheral wall of the flow guide body; a heating member, disposed on a periphery of the flow guide member and spaced apart from the flow guide blade along a radial direction of the flow guide body. The flow guide blade is configured to enable water to flow along the outer peripheral wall of the flow guide body to form a first whirlwind flow and to further form a second whirlwind flow in a gap between the heating member and the flow guide blade. A velocity direction of the first whirlwind flow is projected on a reference plane perpendicular to the axial direction of the flow guide body, generating a first projection; a velocity direction of the second whirlwind flow is projected on the reference plane perpendicular to the axial direction of the flow guide body, generating a second projection; the first projection and the second projection are in opposite directions. The second whirlwind flow is configured to remove bubbles gathered on the heating member.

In some embodiments, the flow guide member includes at least two flow guide blades. The at least two flow guide blades are spaced apart from each other along a circumferential direction of the flow guide body, and are disposed on and curl around the outer peripheral wall of flow guide body.

In some embodiments, the flow guide blade comprises a first guiding section; the first guiding section is connected to the outer peripheral wall of the flow guide body to form a first connection face, the first connection face has a first centerline; an angle between a tangential direction of the first centerline and the axial direction of the flow guide body gradually increases in a direction extending from a water inlet side to a water outlet side of the flow guide member. In this way, a side of the first guiding section facing the water inlet side forms a first concave surface, a side of the first guiding section away from the water inlet side forms a first protruding surface, such that the water flows along the first concave surface to form the first whirlwind flow and further flows from the first concave surface to the first protruding surface to form the second whirlwind flow.

In some embodiments, the flow guide blade further comprises a second guiding section, the second guiding section is disposed at an upstream of the first guiding section, the second guiding section is connected to the outer peripheral wall of the flow guide body to form a second connection face, the second connection face has a second centerline, a first predetermined angle is defined between a tangential direction of the second centerline and the axial direction of the flow guide body, and the first predetermined angle is in a range of 0° to 10°.

In some embodiments, the flow guide blade comprises a third guiding section, the third guiding section is disposed at a downstream of the first guiding section, the third guiding section is connected to the outer peripheral wall of the flow guide body to form a third connection face, the third connection face has a third centerline, an angle between a tangential direction of the third centerline and the axial direction of the flow guide body gradually decreases in the direction extending from the water inlet side to the water outlet side, such that a side of the third guiding section facing the water inlet side forms a second protruding surface, and a side of the third guiding section away from the water inlet side forms a second concave surface.

Alternatively, a second predetermined angle is defined between the tangential direction of the third centerline and the axial direction of the flow guide body.

In some embodiments, the second guiding section, the first guiding section and the third guiding section are sequentially connected, and a connection portion therebetween is smooth.

In some embodiments, the flow guide member further comprises a first end portion disposed at the water inlet side of the flow guide body, a radial size of the first end portion gradually and smoothly decreases in a direction away from the flow guide body, and the first end portion is smoothly connected to an end of the flow guide body.

In addition or alternatively, the flow guide member further comprises a second end portion disposed at the water outlet side of the flow guide body, a radial size of the second end portion gradually and smoothly decreases in the direction away from the flow guide body, and the second end portion is smoothly connected to the other end of the flow guide body.

In some embodiments, the flow guide member comprises the first end portion and the second end portion; the heat collecting pump further comprises an inlet tube disposed at the water inlet side and an outlet end cap disposed at the water outlet side; the inlet tube comprises a tube body and a first bracket, the tube body defines an inlet channel, the first bracket is received in the inlet channel; the outlet end cap comprises an end cap body and a second bracket, the end cap body defines an outlet channel, the second bracket is received in the outlet channel; and the first end portion supports the first bracket, and the second end portion supports the second bracket.

In some embodiments, projections of the first end portion and the inlet channel in a direction perpendicular to the axial direction of the flow guide body are partially overlapped, forming a first overlapping region, a radial size of the inlet channel in the first overlapping region gradually and smoothly increases along the direction extending from the water inlet side to the water outlet side.

In addition or alternatively, projections of the second end portion and the outlet channel in the direction perpendicular to the axial direction of the flow guide body are partially overlapped, forming a second overlapping region, a radial size of the outlet channel in the second overlapping region gradually and smoothly decreases along the direction extending from the water inlet side to the water outlet side.

In some embodiments, the heating member is cylindrical and defines a guiding channel, and the heating member is fixed by being clamped by the inlet tube and the outlet end cap, such that the guiding channel is communicated to the inlet channel and the outlet channel.

In some embodiments, the tube body comprises a first body portion and a first connection stage disposed at an outer periphery of the first body portion, the first body portion defines the inlet channel.

The end cap body comprises a second body portion and a second connection stage disposed at an outer periphery of the second body portion, the second body portion defines the outlet channel.

Two ends of the heating member are connected to and sealed with the first body portion and the second body portion respectively, the heating member is clamped between the first connection stage and the second connection stage.

In some embodiments, a sleeve tube is further included. The sleeve tube sleeves the heating member, one end of the sleeve tube abuts against the first connection stage, and the other end of the sleeve tube is connected to the second connection stage.

In some embodiments, the sleeve tube comprises a third body portion, an engaging plate and a connection plate; the engaging plate is connected to an inner circumferential wall of one end of the third body portion, the connection plate is connected to the other end of the third body portion; the engaging plate is engaged with and aligned to the first connection stage; the third body portion sleeves the heating member; and the connection plate is fixedly connected the said second connection stage, such that the engaging plate abuts against and fixes the inlet tube and the heating member on the outlet end cap.

In some embodiments, the heating member is one of a thick film heating tube, a metal heating tube, a quartz heating tube and a resistor heating tube.

In some embodiments, a pump shell, an impeller and a drive motor are further included. The pump shell is disposed at the water outlet side and defines a pumping channel; the impeller is received in the pumping channel; the drive motor is disposed outside the pump shell and is configured to drive the impeller to rotate, a rotation direction of the impeller is opposite to a rotation direction of the flow guide blade.

Alternatively, the rotation direction of the impeller is the same as the rotation direction of the flow guide blade.

According to another aspect of the present disclosure, a domestic appliance is provided and includes the heat collecting pump as described in the above.

According to the present disclosure, a heat collecting pump and a heating apparatus are provided. By configuring a flow guide member having a specific structure, the second whirlwind flow is formed in the gap between the heating member and the flow guide blade. The second whirlwind flow swirls around the surface of the heating member in order to remove the bubbles that are gathered on the surface of the heating member, such that it may be difficult for the bubbles to stay on the surface of the heating member, preventing the dry burning of the heating member.

BRIEF DESCRIPTION OF THE DRAWINGS

In order to more clearly illustrate the technical solutions in the embodiments of the disclosure and in the related art, the accompanying drawings used for describing the embodiments of the present disclosure and the prior art will be described in brief. Obviously, the drawings in the following description are only some embodiments of the present disclosure, and other drawings may be obtained by an ordinary skilled person in the art based on these drawings without any creative work.

DETAILED DESCRIPTION

Technical solutions in the embodiments of the present disclosure will be clearly and completely described by referring to the accompanying drawings in the embodiments of the present disclosure. Obviously, the described embodiments are only some, but not all, of the embodiments of the present disclosure. All other embodiments obtained by an ordinary skilled person in the art without making creative work based on the embodiments in the present disclosure shall fall within the scope of the present disclosure.

The terms "first", "second" and "third" in the present disclosure are used for descriptive purposes only and shall not be interpreted as indicating or implying relative importance or implicitly specifying the number of the indicated technical features. Therefore, a feature defined by the "first", the "second", or the "third" may explicitly or implicitly include at least one such feature. In the present disclosure, "a plurality of" means at least two, such as two, three, and so on, unless otherwise specifically defined. In addition, terms "include", "have", and any variations thereof, are intended to cover non-exclusive inclusion. For example, a process, a method, a system, a product or an apparatus including a series of operations or units is not limited to the listed operations or units, but may also include operations or units that are not listed. Alternatively, other operations or units that are inherently included in the process, the method, the product or the apparatus may be included.

The "embodiments" in the present disclosure mean that a particular feature, a structure, or characteristic described in an embodiment may be included in at least one embodiment of the present disclosure. Presence of the term at various sections in the specification does not necessarily mean one same embodiment, nor is it a separate or alternative embodiment that is mutually exclusive with other embodiments. The ordinary skilled person in the art shall explicitly and implicitly understand that the embodiments described herein may be combined with other embodiments.

Figure 1:
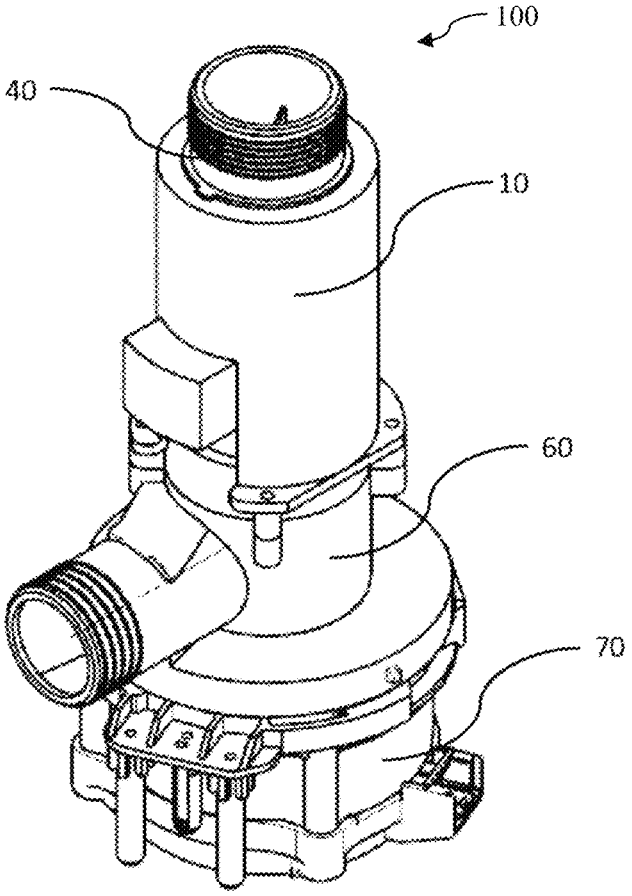
FIG. 1 is a structural schematic view of a heat collecting pump according to some embodiments of the present disclosure.

As shown in FIG. 1, FIG. 1 is a structural schematic view of a heat collecting pump according to some embodiments of the present disclosure.

The heat collecting pump 100 in the present disclosure may be applied in the field of dishwashers and washing machines. The present disclosure does not limit specific fields and scenarios that the heat collecting pump 100 may be applied.

The heat collecting pump 100 includes a flow guide member 20 and a heating member 30. The heating member 30 is configured to surround the flow guide member 20. A gap may be defined between the heating member 30 and the flow guide member 20. Water may be guided by the flow guide member 20 to flow around the heating member 30 and fully contact the heating member 30.

Figure 2:
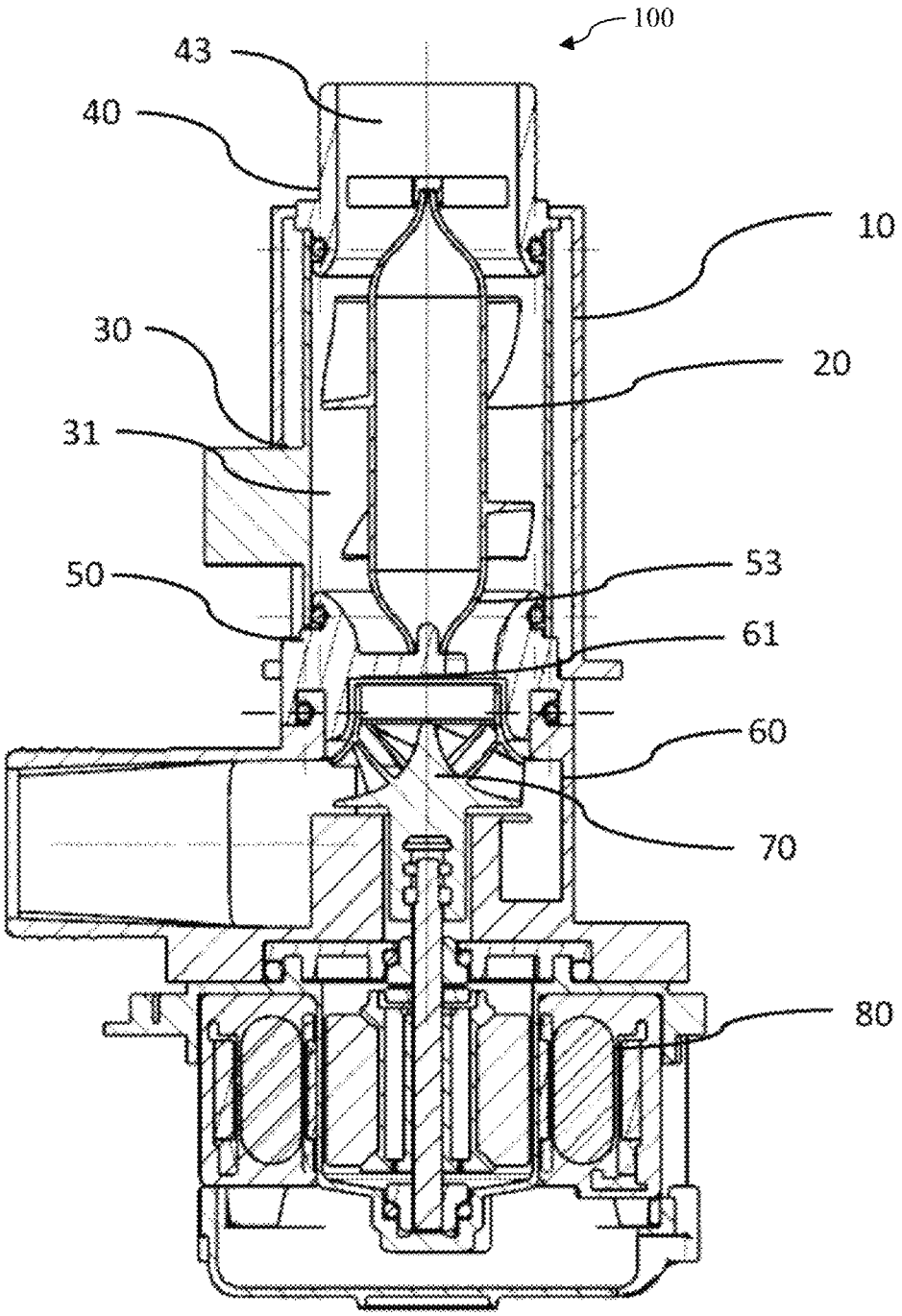
FIG. 2 is a cross section view of the heat collecting pump shown in FIG. 1.
Figure 3:
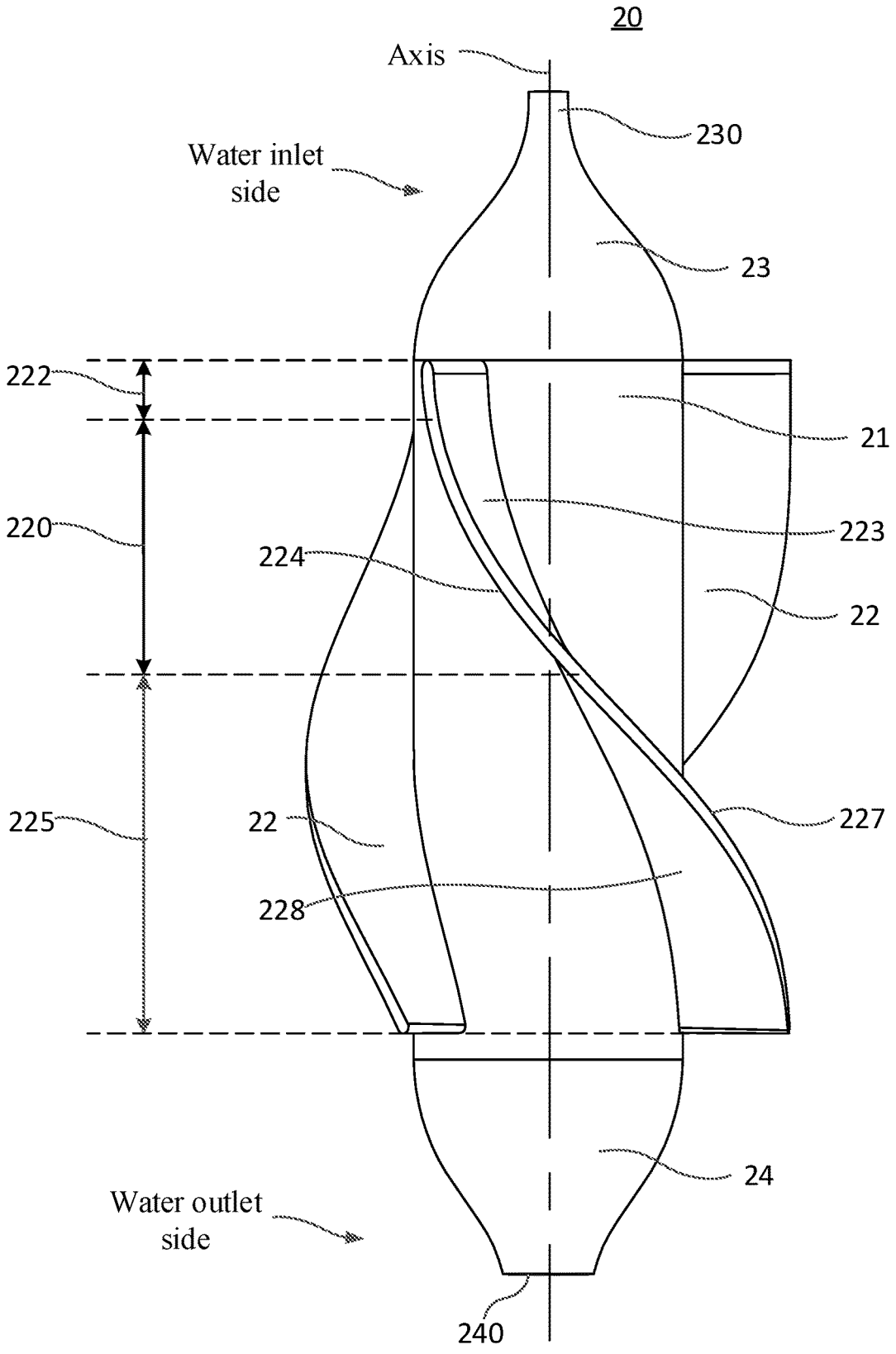
FIG. 3 is a structural schematic view of a flow guide member of the heat collecting pump shown in FIG. 1.
Figure 4:
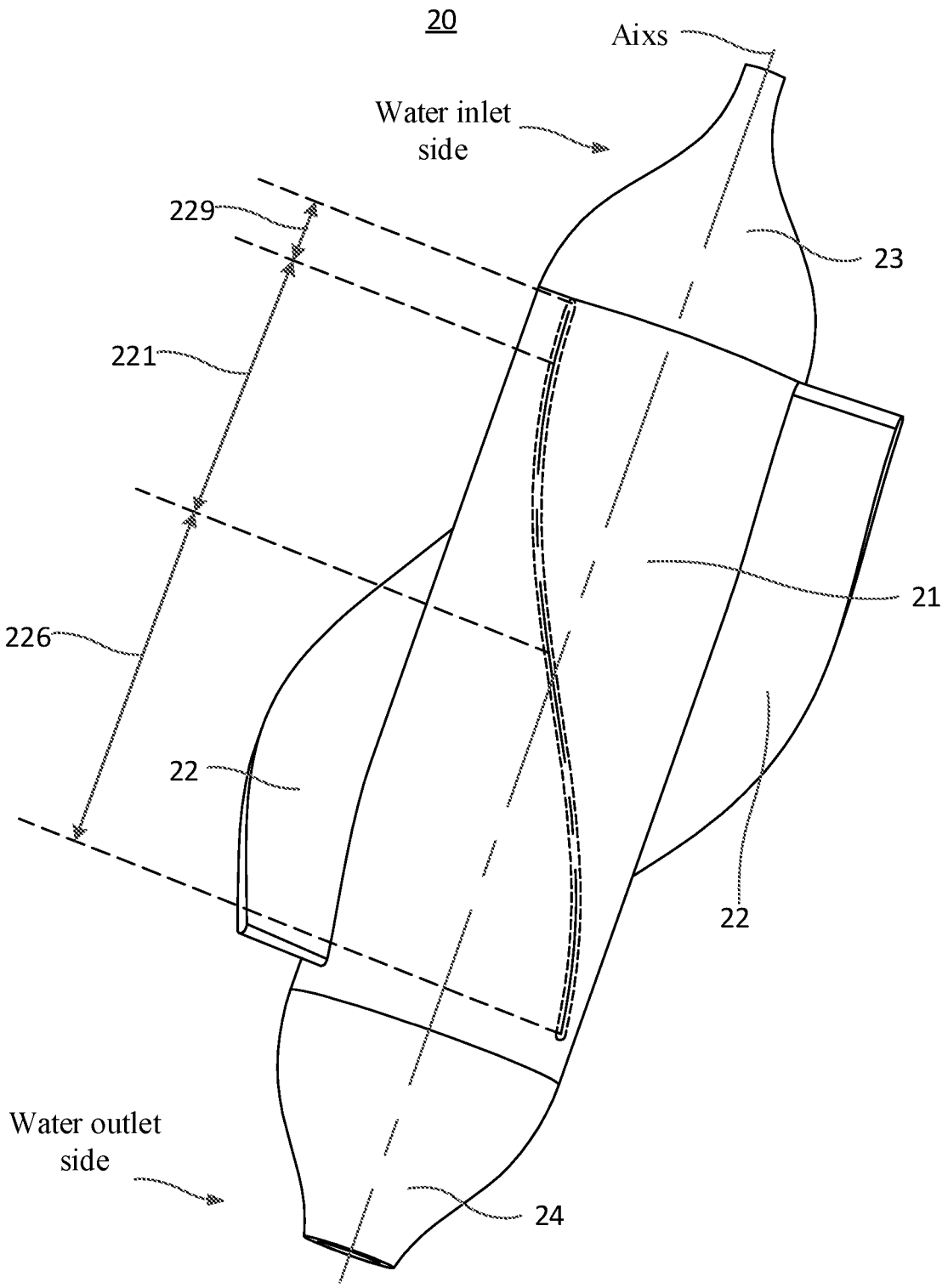
FIG. 4 is a structural schematic view of a connection plane formed by a flow guide blade and a flow guide body of the flow guide member shown in FIG. 4.

As shown in FIGS. 2 to 4, the flow guide member 20 includes a flow guide body 21 and at least one flow guide blade 22. The at least one flow guide blade 22 is disposed on and curls around an outer peripheral wall of the flow guide body 21. The heating member 30 is disposed on a periphery of the flow guide member 20, and is spaced apart from the flow guide blade 22 along a radial direction of the flow guide body 21.

The flow guide blade 22 is configured to enable the water to flow along the outer peripheral wall of the flow guide body 21, forming a first whirlwind flow and further forming a second whirlwind flow in the gap between the heating member 30 and the flow guide blade 22. A velocity direction of the first whirlwind flow is projected on a reference plane perpendicular to the axial direction of the flow guide body 21, forming a first projection. A velocity direction of the second whirlwind flow is projected on the reference plane perpendicular to the axial direction of the flow guide body 21, forming a second projection. The first projection and the second projection are in opposite directions. The second whirlwind flow is configured to remove the bubbles gathered on the heating member 30.

The flow guide blade 22 is disposed on and curls around the outer peripheral wall of the flow guide body 21, such that the water flows along the outer peripheral wall of the flow guide body 21 to form the first whirlwind flow, and a whirlwind direction of the first whirlwind flow is the same as a direction of a curling direction of the flow guide blade 22.

Alternatively, the number of the at least one flow guide blade 22 may be one. The at least one flow guide blade 22 is disposed on and curls around the outer peripheral wall of the flow guide body 21.

Alternatively, the flow guide member 20 includes at least two flow guide blades 22. The number of the at least one flow guide blade 22 may be two, three, four, and the like. The at least two flow guide blades 22 are spaced apart from each other along a circumferential direction of the flow guide body 21, and curl around the outer peripheral wall of the flow guide body 21. For example, the at least two guide blades 22 are evenly distributed on the outer peripheral wall of the guide body 21 and are spaced apart from each other. The at least two flow guide blades 22 curl around the outer peripheral wall of the flow guide body 21. In this way, the water flows along the at least two flow guide blades 22 to whirl around the outer peripheral wall of the flow guide body 21, forming the first whirlwind flow.

The flow guide blade 22 includes a first guiding section 220. The first guiding section 220 is connected to the outer peripheral wall of the flow guide body 21, forming a first connection face. The first connection face has a first centerline 221. An angle between a tangential direction of the first centerline 221 and the axial direction of the flow guide body 21 gradually increases in a direction extending from a water inlet side to a water outlet side of the flow guide member 20. In this way, a side of the first guiding section 220 facing towards the water inlet side forms a first concave surface 223, and the other side of the first guide section 220 away from the water inlet side forms a first protruding surface 224. In this way, the water flows along the first concave surface 223 to form the first whirlwind flow and further flows from the side of the first guiding section where the first concave surface 223 is formed to another side of the first guiding section where the first protruding surface 224 is formed to form the second whirlwind flow.

The first concave surface 223 and the first protruding surface 224 are two opposite sides of the first guiding section 220 and are configured to guide the flow of the water.

In detail, when the water enters the flow guide blade 22, a flow direction of the water is changed by the flow guide blade 22. The flow direction may be changed by the first guiding section 220. A pressure applied on the water by the first concave surface 223 is greater than a pressure applied the water by the first protruding surface 224, such that the water forms the second whirlwind flow in the gap between the heating member 30 and the flow guide blade 22, and flows from the side where the first concave surface 223 is formed to the side where the first protruding surface 224 is formed. The second whirlwind flow flows on and whirls around the surface of the heating member 30. In this way, the bubbles gathered on the surface of the heating member 30 are removed by the second whirlwind flow. That is, the second whirlwind flow may be configured to remove the bubbles gathered on the heating member 30, such that it may be difficult for the bubbles to stay on the surface of the heating member 30, avoiding the dry burning of the heating member 30. The second whirlwind flow further increases a speed of the water flowing in the gap between the heating member 30 and the flow guide blade 22, such that the water may fully contact the heating member 30, heating performance of the heating member 30 may be improved.

In some embodiments, the first guiding section 220 may serve as a head portion of the flow guide blade 22 and is disposed close to the water inlet side of the flow guide member 20. In this way, when the water enters the flow guide member 20 from the water inlet side, the water may enter the first guiding section 220 firstly.

Alternatively, the first guiding section 220 may further serve as the entire flow guide blade 22 and is disposed on the flow guide body 21.

Alternatively, the first guiding section 220 may serve as a partial section of the flow guide blade 22. The flow guide blade 22 may also include other guiding sections. Further, the flow guide blade 22 includes a second guiding section 222. The second guiding section 222 is disposed at an upstream of the first guiding section 220. The second guiding section 222 may be connected to or spaced apart from the first guiding section 220. Further, the second guiding section 222 may be the head portion of the flow guide blade 22, and the water flows through the second guiding section 222 to enter the first guiding section 220.

The second guiding section 222 is connected to the outer peripheral wall of the flow guide body 21 to form a second connection face. The second connection face has a second center line 229. An angle between a tangential direction of the second center line 229 and the axial direction of the flow guide body 21 is a first predetermined angle. That is, an angle between a tangential direction of any point of the second center line 229 and the axial direction of the flow guide body 21 is the first predetermined angle. In this way, the water enters the second guiding section at a substantially non-attack angle relative to the tangential direction of the second centerline 229, such that the flowing speed of the water will not be significantly increased or decreased to cause loss of the water, and a large number of bubbles may not be generated when the water enters the second guiding section.

In some embodiments, the first predetermined angle may be in a range of 0° to 10°, including the 0° and the 10°. Within the range, loss of the water may be minimized when the water flows from the water inlet side along the axial direction of the flow guide body 21 to enter the flow guide blade 22.

In detail, the tangential direction of any point of the second centerline 229 may be parallel to the axial direction of the flow guide body 21. That is, the angle between the tangential direction and the axial direction of the flow guide body 21 may be 0°, such that the water may enter the flow guide blade 22 at the non-attack angle along the axial direction, causing no significant loss of the water. In this way, the water may be avoided from hitting the second guiding section violently at the water inlet side of the flow guide blade 22, which may be caused by an attack angle, the flowing speed of the water may not be significantly changed, and the large number of bubbles may not be generated.

In some embodiments, an angle is present between the direction of the flowing speed of the water on the water inlet side and the axial direction of the flow guide body 21, and the angle is substantially the same as the first predetermined angle. The tangential direction of the second centerline 229 is approximately parallel to the direction of the flowing speed, such that the water enters the second guiding section 222 at a substantially non-attack angle. A deviation angle may be present between the tangential direction of the second centerline 229 and the direction of the flowing speed. For example, the angle may be in a range of 0° to 10°, including the 0° and the 10°. Within the range, loss of the water may be minimized when the water enters the flow guide blade 22.

For example, the angle between the tangential direction of the second centerline 229 and the direction of the flowing speed may be 5°, and loss of the water may be relatively low when the water enters the flow guide blade 22.

Based on the above embodiments, the flow guide blade 22 may further include a third guiding section 225. The third guiding section 225 is disposed at a downstream of the first guiding section 220. The third guiding section 225 is connected to the outer peripheral wall of the flow guide body 21 to form a third connection face, and the third connection face has a third centerline 226.

In some embodiments, an angle between a tangential direction of the third centerline 226 and the axial direction of the flow guide body 21 gradually decreases in a direction extending from the water inlet side to the water outlet side, such that a side of the third guiding section 225 facing the water inlet side forms a second protruding surface 227, and a side of the third guiding section 225 away from the water inlet side forms a second concave surface 228. In this way, in the gap between the heating member 30 and the flow guide blade 22, the water flows from the side where the second concave surface 228 is formed to other side where the second protruding surface 227 is formed, forming a third whirlwind flow. The second concave surface 228 and the second protruding surface 227 are the two opposite sides of the third guiding section 225 and are configured to guide the flow of water.

An extension direction of the third guiding section 225 also directs the water to flow out of the water outlet side and enter an impeller in a whirlwind direction at a second predetermined angle. That is, an angle between a tangential direction of an end point of the third centerline 226 near the water outlet side and the axial direction of the flow guide body 21 is the second predetermined angle. The second predetermined angle is approximately equal to a whirlwind angle of a blade of the impeller, facilitating the water to flow into the impeller and reducing the loss of the force generated by the water.

The whirlwind angle of the blade of the impeller is an angle between a tangent line of a blade profile line and an axis of the impeller. For example, the whirlwind angle is 30°, and the second predetermined angle is also 30°, or the second predetermined angle may be slightly deviated from the whirlwind angle.

In some other embodiments, the angle between the tangential direction of the third centerline 226 and the axial direction of the flow guide body 21 is the second predetermined angle. That is, the angle between the tangential direction at any point of the third centerline 226 and the axial direction of the flow guide body 21 is the second predetermined angle. The second predetermined angle is approximately equal to the whirlwind angle of the blade of the impeller, in order to reduce the loss of the force generated by the water flow.

Alternatively, the flow guide body 21 may further include a plurality of first guiding sections 220 and a plurality of third guiding sections 225. The plurality of first guiding sections 220 and the plurality of third guiding sections 225 are disposed alternately.

In some embodiments, the first guiding section 220 and the third guiding section 225 are connected in sequence. That is, an end of the first guiding section 220 facing the water outlet side is connected to an end of the third guiding section 225 facing the water inlet side, and an end of the third guiding section 225 facing the water outflow side is connected to an end of another first guiding section 220 facing the water inlet side 11. The first guiding section 220 and the third connection line 226 are connected in such a sequence. One of the plurality of first guiding sections 220 serves as the head portion of the flow guide blade 22 facing the water inlet side, and one of the plurality of third guiding sections 226 serves as a tail portion of the flow guide blade 22 facing the water outlet side.

Further, a second guiding section 222 may be configured, serving as the head portion of the flow guide blade 22, and the second guiding section 222 is connected to the first guiding section 220.

In some other embodiments, if the flow guide body 21 is excessively long, the flow guide blade 22 may be separated into a plurality of sections, disposed on the flow guide body 21. For example, the first guiding section 220 and the third guiding section 225 are spaced apart from each other and are alternately disposed on the flow guide body 21. The water successively flows through the first guiding sections 220 and the third guiding sections 225, which are disposed alternately.

In the present embodiments, the flow guide blade 22 includes the first guiding section 220, the second guiding section 222 and the third guiding section 225. The first guiding section 220, the second guiding section 222 and the third guiding section 225 are connected in sequence, and a connection portion between two adjacent sections are smooth. In this way, the force generated by the water may not be changed significantly while the water flows through the connection portion. The water enters the second guiding section 222 in a substantially non-attack angle with respect to the second guiding section 222, and flows through the first guiding section 220 and the third guiding section 225 successively.

It shall be understood that a rotation direction of the impeller is fixed, i.e. the impeller corresponds to one rotation direction. The impeller for example rotates in a clockwise direction or in an anti-clockwise direction.

Alternatively, the whirlwind direction of the flow guide blade 22 along the flow guide body 21 is opposite to the rotation direction of the impeller. For example, when the whirlwind direction of the flow guide blade 22 along the flow guide body 21 is the anti-clockwise direction, and the rotation direction of the impeller is the clockwise direction, the water pre-rotates negatively, and the water enters the impeller at the second predetermined angle that substantially matches the whirlwind angle of the blade of the impeller. Therefore, a lifting height of the heat collecting pump 100 may be increased significantly, and a work capacity of the heat collecting pump 100 may be improved effectively.

Alternatively, the whirlwind direction of the flow guide blades 22 along the flow guide body 21 is the same as the rotation direction of the impeller, and the water pre-rotates positively. The flow guide member 20 may still effectively allow the water to remove the air bubbles from the heating member 30 and increase a heat transfer effect on the water caused by the heating member 30.

The flow guide member 20 further includes a first end portion 23 disposed at the water inlet side of the flow guide body 21. A size of the first end portion 23 in a radial direction gradually and smoothly decreases in a direction away from the flow guide body 21. The first end portion 23 is connected to an end of the flow guide body 21, and a connection portion therebetween is smooth, such that the force generated by the flow may not be lost while the water flows through the first end portion 23 and the connection portion between the first end portion 23 and the flow guide body 21.

In some embodiments, the flow guide member 20 further includes a second end portion 24 disposed at the water inlet side of the flow guide body 21. A size of the second end portion 24 in a radial direction gradually and smoothly decreases in a direction away from the flow guide body 21. The second end portion 24 is connected to an end of the flow guide body 21, and a connection portion therebetween is smooth, such that the force generated by the flow may not be lost while the water flows through the second end portion 24 and the connection portion between the second end portion 24 and the flow guide body 21.

That is, in some embodiments, only one of two ends of the flow guide body 21 is configured with the first end portion 23 or the second end portion 24, such that loss of the force generated by the flow may be minimized while the water flows through one of the two ends of the flow guide member 20. The other end of the flow guide body 21, which is not connected to the first end portion 23 or the second end portion 24, may be configured with a conical portion or a prismatic portion. The conical portion or the prismatic portion may also be configured to support the flow guide member 20 and direct the flow of the water.

In some other embodiments, one of the two ends of the flow guide body 21 has the first end portion 23, and the other end of the flow guide body 21 has the second end portion 24, such that loss of the force generated by the flow may be minimized while the water flows through the two ends of the flow guide member 20.

Other components of the heat collecting pump 100 will be described in the following by taking the flow guide member 20 including the first end portion 23 and the second end portion 24 as an example.

As shown in FIGS. 2 to 7, the heat collecting pump 100 further includes an inlet tube 40 and an outlet end cap 50. The inlet tube 40 is disposed at the water inlet side of the flow guide member, and the outlet end cap 50 is disposed at the water outlet side of the flow guide member.

The inlet tube 40 includes a tube body 41 and a first bracket 42. The tube body 41 defines an inlet channel 43. The first bracket 42 is received in the inlet channel 43. The outlet end cap 50 includes an end cap body 51 and a second bracket 52. The end cap body 51 defines an outlet channel 53. The second bracket 52 is received in the outlet channel 53. The first end portion 23 supports the first bracket 42, and the second end portion 24 supports the second bracket 52, such that the flow guide member 20 is fixed.

In detail, the first bracket 42 includes at least two first spokes 420. An end of one of the at least two first spokes 420 is connected to an end of another one of the at least two first spokes 420. The at least two first spokes 420 spread in a radial pattern. The other end of each of the at least two first spokes 420 is connected to an inner circumferential wall of the tube body 41. A connection portion between the at least two first spokes 420 defines a first insertion hole 421. The first end 23 is configured with a first fixing post 230. The first fixing post 230 is inserted in the first insertion hole 421. An entirety of the first fixing post 230 and the rest of the first end portion 23 is streamlined to reduce the loss of the force generated by the water while the water flows through the first end portion 23. For example, in the present embodiments, the first bracket 42 includes three first spokes 420. The connection portion where the three first spokes 420 are connected defines the first insertion hole 421. Alternatively, each of the three first spokes 420 is connected to a circumference of a wall of an insertion ring, and the insertion ring defines the first insertion hole 421.

The second bracket 52 includes at least two second spokes 520. An end of one of the at least two second spokes 520 is connected to an end of another one of the at least two second spokes 520. The at least two second spokes 520 spread in a radial pattern. The other end of each of the at least two second spokes 520 is connected to an inner circumferential wall of the end cap body 51. A connection portion between the at least two second spokes 520 are configured with a second fixing post 521. The second end portion 24 defines a second insertion hole 240. The second fixing post 521 is inserted in the second insertion hole 240.

Alternatively, each of the first bracket 42 and the second bracket 52 defines the insertion hole, and each of the first end portion 23 and the second end portion 24 may be configured with the fixing post correspondingly. Alternatively, each of the first bracket 42 and the second bracket 52 may both be configured with the fixing post, and each of the first end portion 23 and the second end portion 24 may define the insertion hole correspondingly. Alternatively, the first bracket 42 may be configured with the fixing post, and the second bracket 52 defines the insertion hole.

In this way, by configuring the first bracket 42 and the second bracket 52, the heat conducting member 20 may be easily assembled with and aligned to the first bracket 42 and the second bracket 52, such that a gap between the heat conducting member 20 and the heating member 30 may be uniform, facilitating the bubbles to be removed from the heating member 30.

Figure 6:
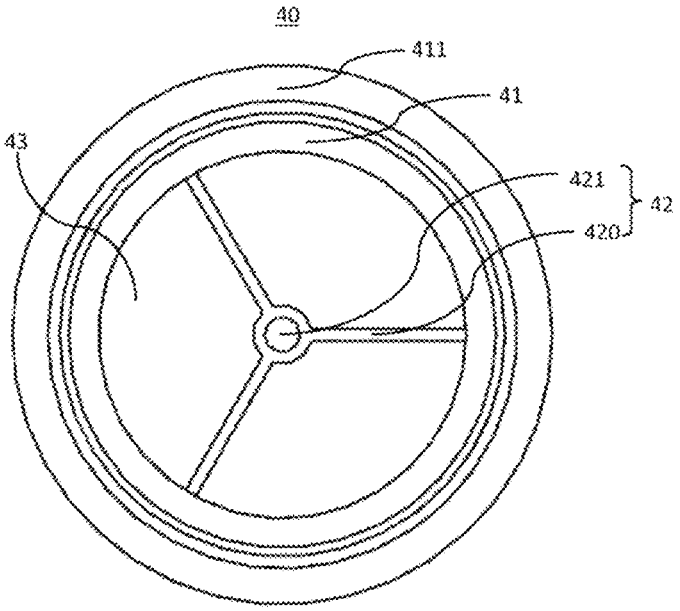
FIG. 6 is a top view of the inlet tube shown in FIG. 6.

Further, as shown in FIG. 2, FIG. 3 and FIG. 6, projections of the first end portion 23 and the inlet channel 43 in a direction perpendicular to the axial direction of the flow guide body 21 are partially overlapped, forming a first overlapping area. The first overlapping area includes the projections of the first end portion 23 and the inlet channel 43. A radial size of the inlet channel 43 in the first overlapping area increases gradually and smoothly in a direction extending from the water inlet side to the water outlet side. That is, a radial size of the inlet channel 43 increases in the direction extending from the water inlet side to the water outlet side as the radial size of a same position of the first end portion 23 increases. In this way, a cross-sectional area of a channel formed by the inlet channel 43 and the first end portion 23 remains approximately constant along the axial direction of the flow guide body 21, such that an area that the water flows through may not change, a speed of the water flowing through the inlet channel 43 may not change, and the bubbles may not be generated.

Projections of the second end portion 24 and the outlet channel 53 in the direction perpendicular to the axial direction of the flow guide body 21 are partially overlapped, forming a second overlapping area. The second overlapping area includes the projections of the second end portion 24 and the outlet channel 53. A radial size of the outlet channel 53 in the second overlapping area decreases gradually and smoothly in the direction extending from the water inlet side to the water outlet side. That is, a radial size of the outlet channel 53 decreases in the direction extending from the water inlet side to the water outlet side as the radial size of a same position of the second end portion 24 decreases. In this way, a cross-sectional area of a channel formed by the outlet channel 53 and the second end portion 24 remains approximately constant along the axial direction of the flow guide body 21, such that an area that the water flows through may not change, a speed of the water flowing through the outlet channel 53 may not change, and the bubbles may not be generated.

As shown in FIG. 2, the heating member 30 is cylindrical and defines a guiding channel 31. The heating member 30 is fixed by being clamped by the inlet tube 40 and the outlet end cap 50, such that the guiding channel 31 is communicated with the inlet channel 43 and the outlet channel 53, and the flow guide member 20 is received in the guiding channel 31.

In some embodiments, the two ends of the heating member 30 are fixedly connected to the inlet tube 40 and the outlet end cap 50 respectively, such that the heating member 30 is clamped between the inlet tube 40 and the outlet end cap 50.

In some other embodiments, the heat collecting pump 100 further includes a sleeve tube 10. The sleeve tube 10 sleeves the heating member 30. The sleeve tube 10 is connected to the outlet end cap 50 to abut against and fix the inlet tube 40 and the heating member 30 on the outlet end cap 50, such that various components of the heat collecting pump 100 may be assembled easier. The sleeve tube 10 is disposed to surround an outer circumference of the heating member 30 to prevent the heating member 30 from being directly contacted, causing injury to a user or being damaged. Further, the inlet tube 40, the outlet end cap 50 and the sleeve tube 10 are removably connected, such that the various components of the heat collection pump 100 may be easily assembled and replaced for maintenance.

Figure 5:
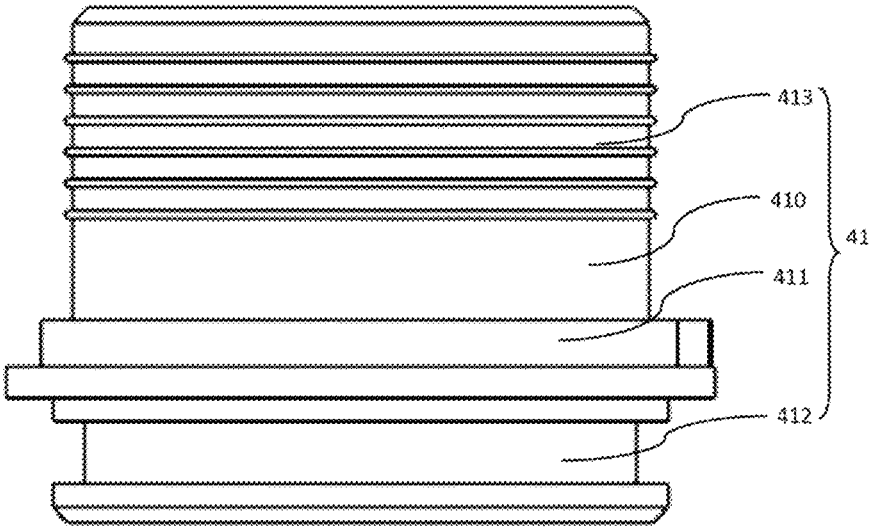
FIG. 5 is a front view of an inlet tube of the heat collecting pump shown in FIG. 1.
Figure 7:
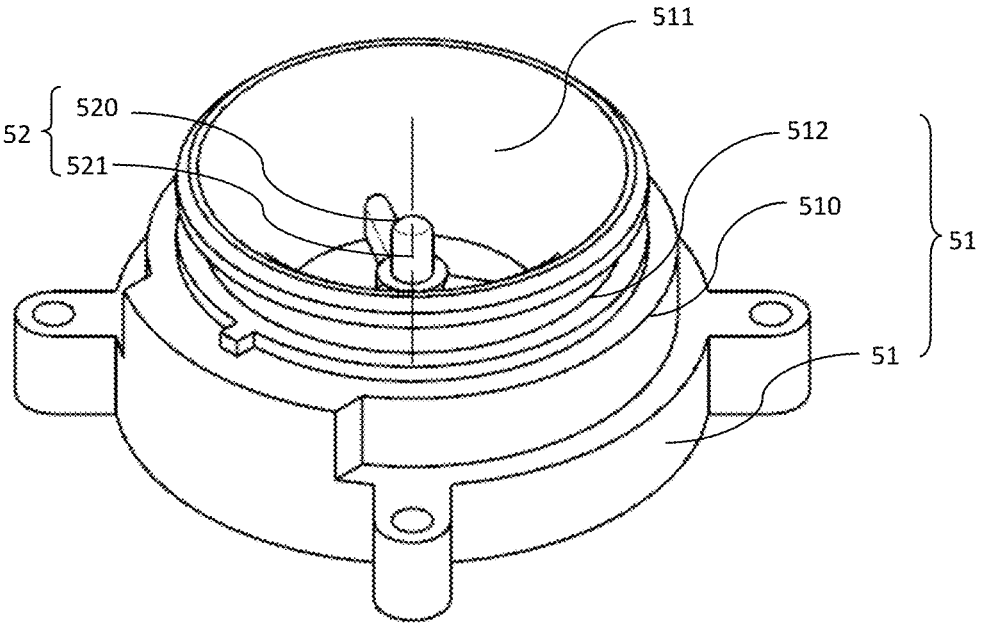
FIG. 7 is a structural schematic view of an outlet end cap of the heat collecting pump shown in FIG. 1.

In detail, as shown in FIGS. 5 to 7, the tube body 41 includes a first body portion 410 and a first connection stage 411 disposed at an outer periphery of the first body portion 410. An outer wall of the first body portion 410 defines a first sealing groove 412, and the first tube body 410 defines the inlet channel 43.

The end cap body 51 includes a second body portion 510 and a second connection stage 511 disposed at an outer periphery of the second body portion 510. An outer wall of the second body portion 510 defines a second sealing groove 512, and the second body portion 510 defines the outlet channel 53.

The first body portion 410 and the second body portion 510 are inserted in two ends of the heating member 30 respectively. The heating member 30 is clamped between the first connection stage 411 and the second connection stage 511. The first body portion 410 is sealed to one of the two ends of the heating member 30 by a first seal (not shown) received in the first sealing groove 412. The second body portion 510 is sealed to the other end of the heating member 30 by a second seal (not shown) received in the second sealing groove 512.

Alternatively, each of the first seal and the second seal is a seal ring.

Figure 8:
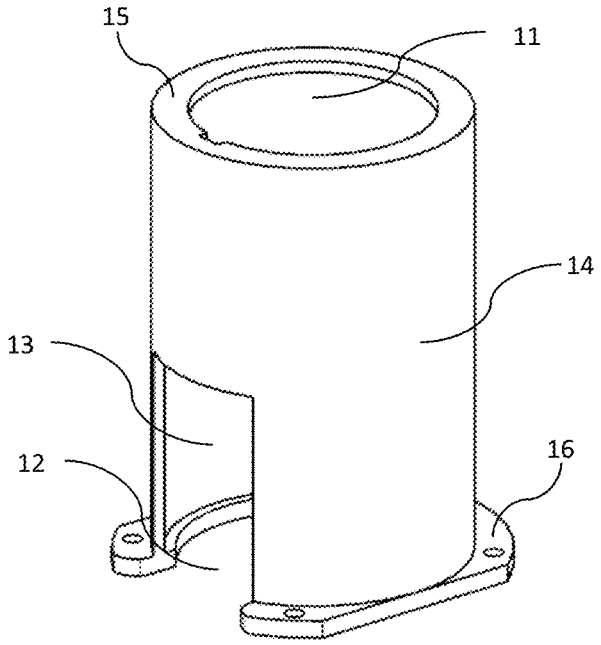
FIG. 8 is a structural schematic view of a sleeve tube of the heat collecting pump shown in FIG. 1.

As shown in FIG. 8, the sleeve tube 10 includes a third body portion 14, an engaging plate 15 and a connection plate 16. The engaging plate 15 is connected to an inner circumferential wall of an end of the third body portion 14. The connection plate 16 is connected to the other end of the third body portion 14. In this way, when the heating member 30 is clamped between the inlet tube 40 and the outlet end cap 50, the engaging plate 15 is aligned to and engaged with the first connection stage 411, the third body portion 14 sleeves the heating member 30, and a gap is defined between the third body portion 14 and the heating member 30. The connection plate 16 is fixedly connected to the second connection stage 511. In this way, the engaging plate 15 abuts against and fix the inlet tube 40 and the heating member 30 on the outlet end cap 50, such that a fastening component may be omitted from being disposed between the heating member 30 and the inlet tube 40 and between the heating member 30 and the outlet end cap 50, a structure of the heating member 30, the inlet tube 40 and the outlet end cap 50 may be simplified, and the heat collecting pump 100 may be assembled more easily.

As shown in FIG. 5, the first tube portion 410 is further configured with a connection section 413. The connection section 413 is disposed on a side of the first connection stage 411, and the first sealing groove 412 is defined in an opposite side of the first connection stage 411. The connection section 413 is configured to connect to an external tube. The connection section 413 may be a threaded structure, an engaging structure or other structures for quick connection.

The first connection stage 411 may be configured with an alignment structure, such as an alignment slot, an alignment post, and the like, to align to and connect to the sleeve tube 10. The first connection stage 411 may further be configured with an alignment structure to align to and seal with the heating member 30 and to prevent the heating member 30 from rotating.

Alternatively, the heating member 30 is one of a thick film heating tube, a metal heating tube, a quartz heating tube and a resistance heating tube.

In some embodiments, the heating member 10 may not be clamped between the inlet tube 40 and the outlet end cap 50.

For example, two ends of the sleeve tube 10 may be connected to the inlet tube 40 and the outlet end cap 50, respectively to encapsulate the flow guide member 20 and the heating member 30. Alternatively, one of the inlet tube 40 and the outlet end cap 50 and the sleeve tube 10 may be an integral and overall structure, such that the other one of the inlet tube 40 and the outlet end cap 50 may be connected to the sleeve tube 10 to encapsulate the flow guide member 20 and the heating member 30.

For example, the heating member 30 is a heating coil, including a plurality of layers of heating rings. The plurality of layers of heating rings are stacked, surrounding an outer side of the flow guide member 20, and are encapsulated in the sleeve tube 10. The water enters a cavity of the sleeve tube 10 from the water inlet side and is guided by the flow guide member 20 to be heated up by the heating member 30. The heated water may flow out through the water outlet side. Alternatively, the heating member 30 includes a plurality of heating plates. The plurality of heating plates are evenly distributed around the flow guide member 20 and are encapsulated within the sleeve tube 10.

The water may form the second whirlwind flow in the gap between the heating member 30 and the flow guide blade 22 as described above. The second whirlwind flow swirls around a surface of the heating member 30 to remove the bubbles adhering to the surface of the heating member 30, preventing dry burning of the heating member 30.

In detail, as shown in FIG. 1 and FIG. 2, the heat collecting pump 100 further includes a pump shell 60, an impeller 70 and a drive motor 80. The pump shell 60 is disposed at the water outlet side of the flow guide member 20 and defines a pumping channel 61. In detail, the pump shell 60 is connected to the outlet end cap 50, and the pumping channel 61 is communicated to the outlet channel 53. The impeller 70 is received in the pumping channel 61. The drive motor 80 is disposed outside the pump shell 60 and drives the impeller 70 to rotate. A rotation direction of the impeller 70 is opposite to the whirlwind direction of the flow guide blade 22. In this way, the water pre-rotates negatively along the flow guide member 20, facilitating a lifting height of the heat collecting pump 100 to be increased.

In some embodiments, the rotation direction of the impeller 70 is the same as the whirlwind direction of the flow guide blade 22.

The present disclosure further provides a domestic appliance (not shown) which includes the heat collecting pump 100 as described above.

The domestic appliance may be, for example, a dishwasher, a washing machine, or other types of household washing appliances.

For example, the domestic appliance may be the dishwasher. The dishwasher includes a body and a heat collecting pump 100 disposed inside the body for heating water. Therefore, when a user uses the dishwasher to wash dishes, the heat collecting pump 100 may be configured to inject hot water into a pool.

According to the present disclosure, a heat collecting pump and a heating apparatus are provided. By configuring a flow guide member having a specific structure, the second whirlwind flow is formed in the gap between the heating member and the flow guide blade. The second whirlwind flow swirls around the surface of the heating member in order to remove the bubbles that are gathered on the surface of the heating member, such that it may be difficult for the bubbles to stay on the surface of the heating member, preventing the dry burning of the heating member.

The above shows only embodiments of the present disclosure and does not to limit the scope of the present disclosure. Any equivalent structure or equivalent process transformation based on the specification and the accompanying drawings of the present disclosure, applied directly or indirectly in other related art, shall be covered by scope of the present disclosure.

What is claimed is:

1. A heat collecting pump, comprising:

a flow guide member, comprising:

a flow guide body;

a first end portion disposed at a water inlet side of the flow guide body, wherein a radial size of the first end portion gradually and smoothly decreases in a direction away from the flow guide body, and the first end portion is smoothly connected to an end of the flow guide body; and a second end portion disposed at a water outlet side of the flow guide body, wherein a radial size of the second end portion gradually and smoothly decreases in the direction away from the flow guide body, and the second end portion is smoothly connected to the other end of the flow guide body;

an inlet tube disposed at the water inlet side and an outlet end cap disposed at the water outlet side;

the inlet tube comprises a tube body and a first bracket, wherein the tube body defines an inlet channel, the first bracket is received in the inlet channel;

the outlet end cap comprises an end cap body and a second bracket, wherein the end cap body defines an outlet channel, the second bracket is received in the outlet channel;

the first end portion supports the first bracket, and the second end portion supports the second bracket; and at least one flow guide blade, wherein the at least one flow guide blade is disposed on an outer peripheral wall of the flow guide body;

a heating member, disposed on a periphery of the flow guide member and spaced apart from the flow guide blade along a radial direction of the flow guide body;

wherein the flow guide blade is configured to enable water to flow along the outer peripheral wall of the flow guide body to form a first whirlwind flow and to further form a second whirlwind flow in a gap between the heating member and the flow guide blade;

a velocity direction of the first whirlwind flow is projected on a reference plane perpendicular to an axial direction of the flow guide body, generating a first projection;

a velocity direction of the second whirlwind flow is projected on the reference plane perpendicular to the axial direction of the flow guide body, generating a second projection;

the first projection and the second projection are in opposite directions; and the second whirlwind flow is configured to remove bubbles gathered on the heating member.

2. The heat collecting pump according to claim 1, wherein the flow guide member comprises at least two flow guide blades; and the at least two flow guide blades are spaced apart from each other along a circumferential direction of the flow guide body, and are disposed on and curl around the outer peripheral wall of the flow guide body.

3. The heat collecting pump according to claim 1, wherein:

the flow guide blade comprises a first guiding section, the first guiding section is connected to the outer peripheral wall of the flow guide body to form a first connection face, the first connection face has a first centerline; an angle between a tangential direction of the first centerline and the axial direction of the flow guide body gradually increases in a direction extending from a water inlet side to a water outlet side of the flow guide member;

such that a side of the first guiding section facing the water inlet side forms a first concave surface, and a side of the first guiding section away from the water inlet side forms a first protruding surface, such that the water flows along the first concave surface to form the first whirlwind flow and further flows from the first concave surface to the first protruding surface to form the second whirlwind flow.

4. The heat collecting pump according to claim 3, wherein:

the flow guide blade further comprises a second guiding section, the second guiding section is disposed upstream of the first guiding section, the second guiding section is connected to the outer peripheral wall of the flow guide body to form a second connection face, the second connection face has a second centerline, and a first predetermined angle is defined between a tangential direction of the second centerline and the axial direction of the flow guide body, such that the water enters the second guiding section at a non-attack angle with respect to the tangential direction of the second centerline.

5. The heat collecting pump according to claim 4, wherein:

the flow guide blade comprises a third guiding section, the third guiding section is disposed downstream of the first guiding section, the third guiding section is connected to the outer peripheral wall of the flow guide body to form a third connection face, the third connection face has a third centerline, an angle between a tangential direction of the third centerline and the axial direction of the flow guide body gradually decreases in the direction extending from the water inlet side to the water outlet side, such that a side of the third guiding section facing the water inlet side forms a second protruding surface, and a side of the third guiding section away from the water inlet side forms a second concave surface; or a second predetermined angle is defined between the tangential direction of the third centerline and the axial direction of the flow guide body.

6. The heat collecting pump according to claim 5, wherein the second guiding section, the first guiding section and the third guiding section are sequentially connected, and a connection portion therebetween is smooth.

7. The heat collecting pump according to claim 1, further comprising:

projections of the first end portion and the inlet channel in a direction perpendicular to the axial direction of the flow guide body are partially overlapped, forming a first overlapping region, a radial size of the inlet channel in the first overlapping region gradually and smoothly increases along the direction extending from the water inlet side to the water outlet side; and/or projections of the second end portion and the outlet channel in the direction perpendicular to the axial direction of the flow guide body are partially overlapped, forming a second overlapping region, a radial size of the outlet channel in the second overlapping region gradually and smoothly decreases along the direction extending from the water inlet side to the water outlet side.

8. The heat collecting pump according to claim 1, wherein:

the heating member is cylindrical and defines a guiding channel, and the heating member is fixed by being clamped by the inlet tube and the outlet end cap, such that the guiding channel is communicated to the inlet channel and the outlet channel.

9. The heat collecting pump according to claim 8, wherein:

the tube body comprises a first body portion and a first connection stage disposed at an outer periphery of the first body portion, the first body portion defines the inlet channel;

the end cap body comprises a second body portion and a second connection stage disposed at an outer periphery of the second body portion, the second body portion defines the outlet channel; and two ends of the heating member are connected to and sealed with the first body portion and the second body portion respectively, the heating member is clamped between the first connection stage and the second connection stage.

10. The heat collecting pump according to claim 9, further comprising a sleeve tube, wherein the sleeve tube sleeves the heating member, one end of the sleeve tube abuts against the first connection stage, and the other end of the sleeve tube is connected to the second connection stage.

11. The heat collecting pump according to claim 10, wherein the sleeve tube comprises a third body portion, an engaging plate and a connection plate;

the engaging plate is connected to an inner circumferential wall of one end of the third body portion, the connection plate is connected to the other end of the third body portion;

the engaging plate is engaged with and aligned to the first connection stage;

the third body portion sleeves the heating member; and the connection plate is fixedly connected to the second connection stage, such that the engaging plate abuts against and fixes the inlet tube and the heating member on the outlet end cap.

12. The heat collecting pump according to claim 1, wherein the heating member is one of a thick film heating tube, a metal heating tube, a quartz heating tube and a resistor heating tube.

13. The heat collecting pump according to claim 1, further comprising a pump shell, an impeller and a drive motor, wherein the pump shell is disposed at a water outlet side and defines a pumping channel;

the impeller is received in the pumping channel;

the drive motor is disposed outside the pump shell and is configured to drive the impeller to rotate, a rotation direction of the impeller is opposite to a rotation direction of the flow guide blade; or the rotation direction of the impeller is the same as the rotation direction of the flow guide blade.

14. A domestic appliance, comprising a body and a heat collecting pump received in the body, wherein the heat collecting pump comprises:

a flow guide member, comprising:

a flow guide body;

a first end portion disposed at a water inlet side of the flow guide body, wherein a radial size of the first end portion gradually and smoothly decreases in a direction away from the flow guide body, and the first end portion is smoothly connected to an end of the flow guide body; and a second end portion disposed at a water outlet side of the flow guide body, wherein a radial size of the second end portion gradually and smoothly decreases in the direction away from the flow guide body, and the second end portion is smoothly connected to the other end of the flow guide body;

an inlet tube disposed at the water inlet side and an outlet end cap disposed at the water outlet side;

the inlet tube comprises a tube body and a first bracket, wherein the tube body defines an inlet channel, the first bracket is received in the inlet channel;

the outlet end cap comprises an end cap body and a second bracket, wherein the end cap body defines an outlet channel, the second bracket is received in the outlet channel;

the first end portion supports the first bracket, and the second end portion supports the second bracket; and at least one flow guide blade, wherein the at least one flow guide blade is disposed on an outer peripheral wall of the flow guide body;

a heating member, disposed on a periphery of the flow guide member and spaced apart from the flow guide blade along a radial direction of the flow guide body;

wherein the flow guide blade is configured to enable water to flow along the outer peripheral wall of the flow guide body to form a first whirlwind flow and to further form a second whirlwind flow in a gap between the heating member and the flow guide blade;

a velocity direction of the first whirlwind flow is projected on a reference plane perpendicular to an axial direction of the flow guide body, generating a first projection;

a velocity direction of the second whirlwind flow is projected on the reference plane perpendicular to the axial direction of the flow guide body, generating a second projection;

the first projection and the second projection are in opposite directions; and the second whirlwind flow is configured to remove bubbles gathered on the heating member.

15. The domestic appliance according to claim 14, wherein the flow guide member comprises at least two flow guide blades; and the at least two flow guide blades are spaced apart from each other along a circumferential direction of the flow guide body, and are disposed on and curl around the outer peripheral wall of the flow guide body.

16. The domestic appliance according to claim 14, wherein:

the flow guide blade comprises a first guiding section;

the first guiding section is connected to the outer peripheral wall of the flow guide body to form a first connection face, the first connection face has a first centerline;

an angle between a tangential direction of the first centerline and the axial direction of the flow guide body gradually increases in a direction extending from a water inlet side to a water outlet side of the flow guide member;

such that a side of the first guiding section facing the water inlet side forms a first concave surface, a side of the first guiding section away from the water inlet side forms a first protruding surface, such that the water flows along the first concave surface to form the first whirlwind flow and further flows from the first concave surface to the first protruding surface to form the second whirlwind flow.

17. The domestic appliance according to claim 16, wherein:

the flow guide blade further comprises a second guiding section, the second guiding section is disposed upstream of the first guiding section, the second guiding section is connected to the outer peripheral wall of the flow guide body to form a second connection face, the second connection face has a second centerline, and a first predetermined angle is defined between a tangential direction of the second centerline and the axial direction of the flow guide body, such that the water enters the second guiding section at a non-attack angle with respect to the tangential direction of the second centerline.

18. The domestic appliance according to claim 17, wherein:

the flow guide blade comprises a third guiding section, the third guiding section is disposed downstream of the first guiding section, the third guiding section is connected to the outer peripheral wall of the flow guide body to form a third connection face, the third connection face has a third centerline, an angle between a tangential direction of the third centerline and the axial direction of the flow guide body gradually decreases in the direction extending from the water inlet side to the water outlet side, such that a side of the third guiding section facing the water inlet side forms a second protruding surface, and a side of the third guiding section away from the water inlet side forms a second concave surface; or a second predetermined angle is defined between the tangential direction of the third centerline and the axial direction of the flow guide body.

* * * * *